US007784424B2

(12) United States Patent
Wentworth et al.

(10) Patent No.: US 7,784,424 B2
(45) Date of Patent: Aug. 31, 2010

(54) HEATED TOWEL DISPENSER

(75) Inventors: Robert J. Wentworth, Farmington Hills, MI (US); Lionel Belanger, Northville, MI (US)

(73) Assignee: Belanger Industrial Products, Inc., Northville, MI (US)

( * ) Notice: Subject to any disclaimer, the term of this patent is extended or adjusted under 35 U.S.C. 154(b) by 1314 days.

(21) Appl. No.: 11/164,383

(22) Filed: Nov. 21, 2005

(65) Prior Publication Data

US 2007/0012713 A1 Jan. 18, 2007

Related U.S. Application Data

(60) Provisional application No. 60/629,912, filed on Nov. 22, 2004.

(51) Int. Cl.
*B05C 3/12* (2006.01)

(52) U.S. Cl. ..... 118/419; 118/423

(58) Field of Classification Search ..... 118/419, 118/423, 712, 697, 709, 313, 411, 412, 37–38, 118/325; 242/563, 564.4, 598.6
See application file for complete search history.

(56) References Cited

U.S. PATENT DOCUMENTS

| | | | | |
|---|---|---|---|---|
| 3,368,522 | A * | 2/1968 | Cordis | 118/43 |
| 4,442,788 | A * | 4/1984 | Weis | 118/405 |
| 5,813,624 | A * | 9/1998 | Grasso et al. | 242/560 |
| 6,085,899 | A * | 7/2000 | Thorsbakken | 206/205 |
| 6,213,424 | B1 * | 4/2001 | Helfer-Grand | 242/564.1 |
| 6,431,111 | B1 * | 8/2002 | Zhang | 118/43 |
| 6,457,434 | B1 * | 10/2002 | Lazar | 118/32 |
| 6,895,296 | B2 * | 5/2005 | Holt et al. | 700/139 |
| 7,219,852 | B2 * | 5/2007 | Tramontina et al. | 242/422.5 |

* cited by examiner

*Primary Examiner*—Brenda A Lamb
(74) *Attorney, Agent, or Firm*—Dickinson Wright PLLC

(57) ABSTRACT

A heated towel dispenser includes a roll of a semi-absorptive medium that can be readily separated into individual sheets. The dispenser includes one or more different fluids to be applied to each of the sheets as directed by a user. The dispenser includes a heating element therein to heat each of the sheets prior to them being emitted from the dispenser. A plurality of sensors are disposed in the dispenser to monitor conditions within the dispenser.

28 Claims, 1 Drawing Sheet

HEATED TOWEL DISPENSER

CROSS-REFERENCE TO RELATED APPLICATIONS

The present application claims priority from U.S. Provisional Application Ser. No. 60/629,912, entitled "Heated Towel Dispenser" and filed Nov. 22, 2004.

TECHNICAL FIELD

The present invention relates generally to a heated towel dispenser, and more particularly to a heated towel dispenser that allows a user to select from one or more fluid solutions to be applied to the towel prior to its dispensing and use.

BACKGROUND OF THE INVENTION

Towel dispensers are well known for dispensing dry paper towels, such as are used in restrooms and the like. These towel dispensers are suitable for their purposes, but are limited generally to the purpose of emitting towels for use in drying a user's hands, face or the like or soaking up water or other spilled fluid in the surrounding area.

Other paper dispensers are also known, but they are similarly limited and therefore disadvantageous. For example, moist wipes having a disinfecting fluid or the like, therein that are sold to assist an adult while they are changing children's diapers are also known. These wipes are also sold in travel packs that allow for their dispensing for use in cleaning up messes, but the wipes are not heated. In order to heat these wipes, they must be removed from their package or dispenser and placed into separate heated storage containers, which are typically plugged into a conventional outlet.

Therefore, a need exists for a towel dispenser that can dispense heated moist or damp towels. Additionally, a need exists for a towel dispenser that allows a user to select from different types of fluid solutions to be applied to the towel prior to its dispensing to best suit the user's needs.

SUMMARY OF THE INVENTION

One advantage of the present invention is to provide a heated towel dispenser that emits heated towels having a disinfecting fluid or solution applied thereon.

It is another advantage of the present invention is to provide a heated towel dispenser that emits heated towels having a user selected fluid or solution thereon that meets the user's requirements.

It is still another advantage of the present invention to provide a coin operated heated towel dispenser.

It is a further advantage of the present invention is to provide a heated towel dispenser that allows for remote monitoring of the amount of towels remaining in the dispenser.

It is yet another advantage of the present invention to provide a heated towel dispenser that allows for remote monitoring of the levels of various fluids within the dispenser which are to be applied to the towels prior to dispensing.

It is yet a further advantage of the present invention to provide a heated towel dispenser that includes multiple rolls of a dispensing media therein that seamlessly pulls media from the additional roll when the first roll runs out.

In accordance with the above and the other advantages of the present invention, a heated towel dispenser is provided. The heated towel dispenser includes a roll of a semi-absorptive medium that can be readily separated into individual sheets. The dispenser includes one or more different fluids to be applied to each of the sheets as directed by a user. A heating element is also disposed within the dispenser to heat each of the sheets prior to being dispensed from the unit for use by the user.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Referring now to the Figures, which illustrate a heated towel dispenser in accordance with the present invention. The heated towel dispenser disclosed herein can be utilized in a variety of locations for a multitude of different purposes. For example, the heated towel dispenser can be utilized in grocery stores or supper markets to dispense heated towels or wipes with disinfectant thereon to clean or wipe down shopping carts prior to their utilization. It will be understood that the disclosed heated towel dispenser can be utilized in a variety of different locations, such as at vehicle wash locations, including self-serve vehicle wash locations. Moreover, the disclosed heated towel dispenser can be utilized for a variety of different purposes and can take on a variety of different configurations. It will also be understood by one of ordinary skill in the art that a variety of different fluids may be applied to wipes for dispensing that do not require heating.

Figure 1:
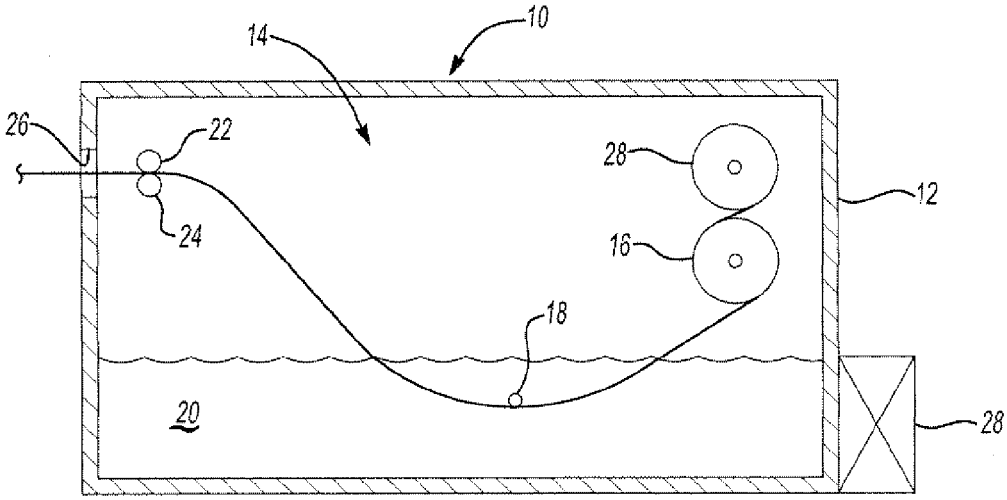
FIG. 1 is a schematic illustration of a heated towel dispenser in accordance with one embodiment of the present invention.

FIG. 1 illustrates one embodiment of a heated towel dispenser 10. The heated towel dispenser 10 includes a housing 12 having an interior 14 located within the housing 12. The housing 12 can be formed of a variety of materials, including metal or an injection molded plastic. The housing can be opened such as by a door or by opening the top half of the housing with respect to the bottom half to allow access to the interior 14 as required.

In this embodiment, the dispenser 10 includes a roll 16 consisting of individual sheets of a semi-absorptive medium such as paper towels or the like disposed therein. In one embodiment, the sheets that make up the roll 16 consist of a paper-based material; however a variety of other suitable materials can be utilized, such as cloth or the like. The roll 16 preferably consists of a predetermined number of individual sheets that can be separated from the roll 16 such that only one sheet is emitted from the dispenser 10 at a given time. In order to facilitate separation from the roll 16, perforations, score marks or the like are included therein to facilitate separation of each sheet from the roll 16. Additionally, the dispenser 10 can include a tear off mechanism that will separate the individual sheet from the roll 16 for dispensing. Further, the dispenser 10 can include an embosser to stamp or emboss logos onto individual sheets as they are emitted from the dispenser 10. Moreover, the roll 16 can be formed with no perforations and in this instance the sheets will require cutting to facilitate dispensing.

As shown, the roll 16 is configured such that the medium thereon passes through a fluid 20 disposed in the bottom of the interior 14 of the housing 12. The fluid 18 disposed in the housing is preferably a disinfectant. However, as discussed below, a variety of other suitable fluids can be utilized. The medium from the roll 16 communicates with a roller 18 disposed in the housing to assist in directing the medium and ensure that it passes through the fluid 20. Thereafter, the medium passes through a pair of closely spaced rollers 22, 24, which act to squeeze out any excess fluid from the medium before it exits the housing 12 through an opening 26. Further, a heating element 28 is disposed in the housing 12 to heat the fluid 20 to a predetermined temperature. It will be understood that the heating element can be disposed remote from the housing 12, but still communicates with the fluid to impart heat thereto. It will also be understood that any number of rollers may be utilized and that they may have a variety of different configurations and orientations.

The dispenser 10 operates such that when a user desires a sheet of paper from the roll 16, a stepper motor or the like advances the roll 16 a sufficient distance such that a single sheet is emitted from the interior 14 through the opening 26 for removal by the user. Additionally, in one embodiment, the dispenser 10 includes an additional roll 28 located within the housing 12 that is intended to seamlessly deliver paper out the opening 26 in the same fashion discussed above, in the event the first roll 16 runs out of paper before the dispenser 10 is serviced.

Figure 2:
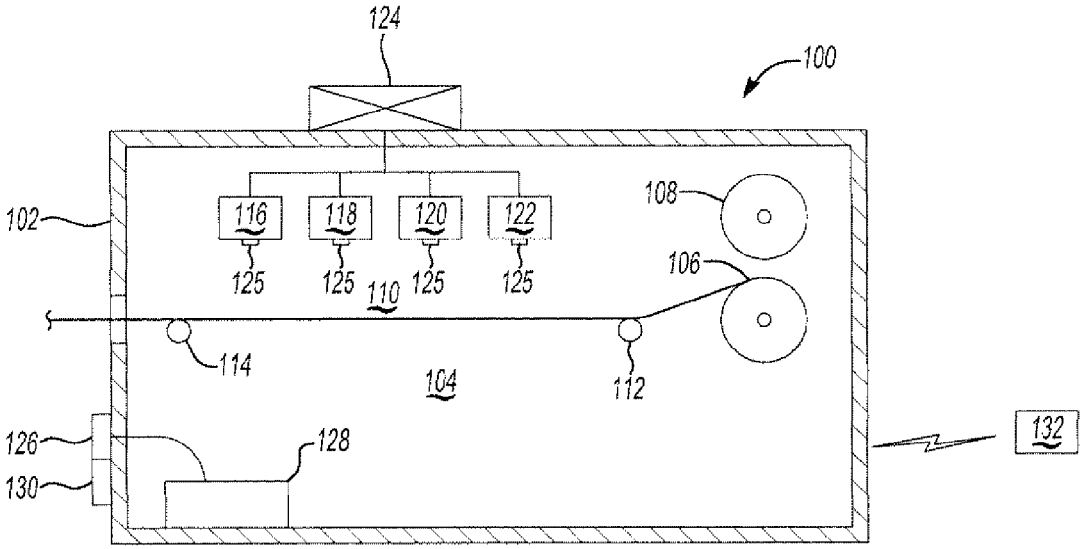
FIG. 2 is a schematic illustration of a heated towel dispenser in accordance with another embodiment of the present invention.

FIG. 2 illustrates another embodiment of a heated towel dispenser 100 in accordance with present invention. In this embodiment, the heated towel dispenser 100 includes a housing 102 having an interior 104 located within the housing 102. The housing 102 can be formed of a variety of materials, including metal or an injection molded plastic. In this embodiment, the dispenser 100 also includes a roll 106 located in the interior 104, which includes individual sheets of a semi-absorptive medium, such as individual paper towels or the like, disposed thereon. In one embodiment, the sheets that make up the roll 106 preferably consist of a paper-based material; however a variety of other suitable materials can be utilized. The roll 106 also preferably consists of a predetermined number of individual sheets that can be separated from the roll 106 in a known fashion, such as through the inclusion of perforations or score marks, in order that one sheet is emitted from the dispenser 10 at a given time. The housing 102 preferably includes at least one additional roll 108 disposed therein that replaces the roll 106 in the event it runs out of paper prior to service of the dispenser 100.

In this embodiment, the medium from the roll 106 passes over a spray area 110 and is supported by a plurality of rollers 112, 114. It will be understood that the way by which the roll medium is conveyed to and supported in the spray area 110 can vary as required. The dispenser 100 also includes a plurality of different fluid supply tanks 116, 118, 120, 122. Each of the fluid supply tanks 116, 118, 120, 122 contains a different solution to be applied to the medium. Each of the supply tanks 116, 118, 120, 122 is in communication with a nozzle 125 or other spraying device to convey the fluid from one of the tanks 116, 118, 120, 122 onto the medium. It will be understood that the fluids can be sprayed onto the medium either alone or in combination with another of the solutions from one of the other supply tanks.

The fluids in the supply tanks can vary and can include a disinfectant, a window washing solution, an upholstery cleaner, or a rubber cleaner product, such as for vehicle tires. Obviously, a variety of other types of fluids can be included in the supply tanks for emission onto the medium. It will also be understood that while nozzles are disclosed as the mechanism for spraying the fluid onto the medium, the fluid can be applied to the medium in a variety of other suitable ways. Additionally, each of the supply tanks 116, 118, 120, 122 are in communication with a heating element 124 to keep the fluid warm such that a warm fluid is applied to the medium. Alternatively, the fluid can be applied at its ambient temperature and then the sheets can be emitted before dispensing. In order to facilitate spraying, the supply tanks 116, 118, 120, 122 can be secured to a rotating wheel, such that once the desired fluid to be supplied to the medium has been selected, the conveyer will rotate such that the proper fluid is oriented over the medium in the spray area. The user can effectuate the fluid selection such as through a key-pad or user input mechanism 130 that is in communication with the supply tanks that allows the user to select which fluid or fluids to be applied to the sheets.

In operation, the dispenser 100 is preferably coin operated. Thus, a coin receptacle 126 is included in the exterior of the housing 102. When a coin is inserted into the coin receptacle 126, a computer 128 or reader ensures that the appropriate amount of money has been inserted into the dispenser 100. A change dispenser can also be included to allow the dispenser 100 to accept paper bills and emit coins as required. Alternatively, the dispenser 100 may also be fitted with a card reader to allow a user to pay by credit or debit card. Once the correct amount of money has been acknowledged, the user is prompted to select which of the fluids the user desires on a towel. Once the user selects the desired fluid, the conveyer or other mechanism is actuated by the computer 128 to direct to proper supply tank over the medium in the spraying area 110. Thereafter, the heated fluid is applied onto the medium in an amount such that it is damp or moist. Once the heated fluid is applied onto medium, the computer 128 directs a motor or other device to advance the roll 106 to emit the sheet of medium containing the desired fluid out the opening 130 in the housing for removal and use by the user.

The computer 128 is preferably configured to track a variety of conditions in the dispenser. For example, the computer 128 preferably tracks the amount of money that has been inserted into the machine. The computer also tracks the level of fluid in each of the supply tanks 116, 118, 120, 122. Further, the computer 128 also tracks how much of the paper medium on the roll 106 has been utilized. The computer 128 also tracks other error codes or conditions. The tracking is preferably accomplished through the use of sensors or other known suitable apparatus which are in communication with the computer. The computer 128 is in periodic communication, whether wirelessly or by modem, to transfer this information to a remote computer 132. This allows the owner of the machine to determine when service or attention is required to be given to the dispenser. This is advantageous, particularly when the owner controls many different machines, to prevent unnecessary service calls as well as ensuring that service call are not unnecessarily delayed. This provides improved cost operation and decreased cost to the owner as well as ensuring proper operation of the machine.

While particular embodiments of the invention have been shown and described, numerous variations and alternate embodiments will occur to those skilled in the art. Accordingly, it is intended that the invention be limited only in terms of the appended claims.

What is claimed is:

1. A towel dispenser, comprising:

a housing, having an opening therein, and an interior;

a plurality of rolls each consisting of a plurality of sheets of a semi-absorptive medium, disposed in said interior of said housing, at least one liquid disposed in said interior and intended to communicate with said semi-absorptive medium;

a mechanism for advancing each of said roll to emit at least one of said plurality of sheets of said semi-absorptive medium through said opening and a computer for monitoring a variety of conditions in said housing, including an amount of said semi-absorptive medium on at least one of said plurality of rolls;

said computer directing said mechanism such that seamlessly pulling of said semi-absorptive medium occurs from another of said plurality of rolls when said computer determines that said semi-absorptive medium on said one of said plurality of rolls has run out.

2. The dispenser of claim 1, wherein said plurality of sheets of said semi-absorptive medium are presectioned for ease of separation.

3. The dispenser of claim 1, wherein said at least one liquid is located in a tray in said interior of said housing and each of said plurality of sheets of said semi-absorptive medium is passed therethrough before being emitted through said opening.

4. The dispenser of claim 1, wherein a plurality of liquids are disposed in said interior of said housing which can be individually applied to one of said plurality of sheets as selected by a user.

5. The dispenser of claim 1, wherein a heating element warms said at least one liquid prior to application to said plurality of sheets of said semi-absorptive medium.

6. The dispenser of claim 1, further comprising:

a payment acceptance mechanism that allows a user to make payment to receive one of said plurality of sheets from the dispenser.

7. A towel dispenser comprising:

a housing having an interior, an exterior, and an opening formed therein;

a roll consisting of a plurality of sheets of a semi-absorptive medium, disposed in and rotatable with respect to said housing;

a plurality of supply tanks each containing a liquid disposed therein, which are intended for application to said plurality of sheets of said semi-absorptive medium;

an actuator in communication with said plurality of liquids to allow for selective application of one of said plurality of liquids to said one of said plurality of sheets;

a single heating element in communication with each of said supply tanks for heating said plurality of liquids;

plurality of sensors including those for monitoring the quantity of each of said plurality of liquids;

a mechanism for rotating said roll and advancing said plurality of sheets of said semi-absorptive medium such that at least one of said plurality of sheets is emitted through the opening;

whereby said at least one sheet of semi-absorptive medium emitted through said opening has one of said plurality of liquids disposed thereon.

8. The dispenser of claim 7, wherein said plurality of sheets of said semi-absorptive medium are presectioned to allow for ease of operation.

9. The dispenser of claim 7, wherein said housing includes a cutting mechanism associated therewith to allow one of said plurality of sheets to be torn off by a user.

10. The dispenser of claim 7, wherein said supply tanks are bottles and each of said plurality of liquids are applied to said plurality of sheets by spraying.

11. The dispenser of claim 7, further comprising:

a user input mechanism in communication with the dispenser to allow said user to select which of said plurality of liquids to apply to said one of said plurality of sheets.

12. The dispenser of claim 11, wherein said plurality of sensors are disposed in said housing for monitoring; and including and the quantity of semi-absorptive medium remaining on said roll.

13. The dispenser of claim 12, wherein said plurality of sensors are in communication with a local computer which can communicate with a remote computer to allow for remote monitoring of the dispenser.

14. A heated towel dispenser, comprising:

a housing having an interior, an exterior, and an opening formed therein;

a roll consisting of a plurality of sheets of a semi-absorptive medium disposed in and rotatable with respect to said housing;

a plurality of liquids located in said interior and intended to communicate with said plurality of sheets of said semi-absorptive medium said liquids are located separately from one another;

at least one heating element disposed within said housing for heating said plurality of liquids;

a computer for monitoring various conditions in said housing, including a fluid level of each of said plurality of liquids and a number corresponding to said plurality of sheets on said roll;

whereby said at least one sheet of said semi-absorptive medium is emitted through said opening and includes at least one of said plurality of liquids disposed thereon.

15. The dispenser of claim 14, wherein said plurality of sheets of said semi-absorptive medium are presectioned to allow for ease of separation.

16. The dispenser of claim 14, wherein said at least one of said plurality of liquids is located in a tray in said interior and each of said plurality of sheets of said semi-absorptive medium is passed therethrough prior to being emitted through said opening.

17. The dispenser of claim 14, further comprising:

a user interactive device on said exterior of said housing to allow the user to choose which of said plurality of liquids to be applied to said one of said plurality of sheets.

18. The dispenser of claim 14, further comprising:

a plurality of sensors disposed in said housing, which transmit information to said computer, including the quantity remaining of said at least one of said plurality of liquids and the quantity of semi-absorptive medium remaining on said roll.

19. The dispenser of claim 18, wherein said computer can communicate with a remote computer to allow for remote monitoring of the dispenser.

20. The dispenser of claim 17, wherein a user input mechanism allows the user to make appropriate payment for use of the dispenser.

21. The dispenser of claim 1, further comprising:

a heating element disposed within said housing for heating said liquid.

22. The dispenser of claim 7, further comprising:

at least one heating element disposed within said housing and in communication with said plurality of liquids.

23. A towel dispenser, comprising:

a housing having an opening therein and an interior;

a plurality of rolls each consisting of a plurality of sheets of a semi-absorptive medium, disposed in said interior of said housing;

a plurality of liquids disposed in said interior, which are intended for application to said plurality of sheets of said semi-absorptive medium;

an actuator in communication with said plurality of liquids to allow for selective application of one of said plurality of fluids to said one of said plurality of sheets;

a computer for monitoring various conditions in said housing, including an amount of fluid remaining in each of said plurality of fluids, said computer operable to transmit said monitored conditions to a remote computer; and a mechanism for rotating said roll and advancing said plurality of sheets of said semi-absorptive medium such that at least one of said plurality of sheets is emitted through said opening.

24. The dispenser of claim 23, further comprising:

at least one heating element disposed within said housing and in communication with said plurality of liquids.

25. The dispenser of claim 19, wherein said remote computer receives information about said conditions in said housing, including said liquid level in each of said plurality of liquids and said number of said plurality of sheets on said roll.

26. A towel dispenser, comprising:

a housing having an interior, and an opening formed therein;

a roll consisting of a plurality of sheets of a semi-absorptive medium disposed in and rotatable with respect to said housing;

a plurality of liquids disposed in said interior, which are intended for application to said plurality of sheets of said semi-absorptive medium;

an actuator in communication individually with each of said plurality of liquids to allow for selective application of one said plurality of liquids to said one of said plurality of sheets;

a mechanism for rotating said roll and advancing said plurality of sheets of said semi-absorptive medium such that at least one of said plurality of sheets is emitted through said opening;

a plurality of sensors disposed in said housing for monitoring certain conditions, including the quantity remaining of each of said plurality of liquids and the quantity of semi-absorptive medium remaining on said roll said plurality of sensors in communication with a computer to allow for remote monitoring of the dispenser;

wherein each of said plurality of liquids are retained in bottles and are applied to said plurality of sheets by spraying;

whereby said at least one sheet of semi-absorptive medium emitted through said opening has one of said plurality of liquids disposed therein.

27. The dispenser of claim 26, further comprising:

at least one heating element disposed within said housing and in communication with said plurality of liquids.

28. The dispenser of claim 26, further comprising:

a user input mechanism in communication with the dispenser to allow said user to select which of said plurality of fluids to apply to said one of said plurality of sheets.

* * * * *